US011747107B2

(12) United States Patent
Yeates

(10) Patent No.: US 11,747,107 B2
(45) **Date of Patent: *Sep. 5, 2023**

(54) OVERMOLDED / THROUGH-MOLDED HOLSTER

(71) Applicant: Sentry Solutions Products Group LLC, Virginia Beach, VA (US)

(72) Inventor: Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/462,308

(22) PCT Filed: Mar. 26, 2018

(86) PCT No.: PCT/US2018/024320

§ 371 (c)(1),
(2) Date: May 20, 2019

(87) PCT Pub. No.: WO2018/183183

PCT Pub. Date: Oct. 4, 2018

(65) Prior Publication Data

US 2020/0011637 A1 Jan. 9, 2020

Related U.S. Application Data

(60) Provisional application No. 62/476,836, filed on Mar. 26, 2017.

(51) Int. Cl.
*F41C 33/02* (2006.01)

(52) U.S. Cl.
CPC ..... *F41C 33/0245* (2013.01); *F41C 33/0236* (2013.01)

(58) Field of Classification Search
CPC ..... F41C 33/0245; F41C 33/0236
See application file for complete search history.

(56) References Cited

U.S. PATENT DOCUMENTS

| | | | | |
|---|---|---|---|---|
| 7,950,552 | B2 * | 5/2011 | Fan | A45F 5/02 224/243 |
| 8,177,108 | B1 * | 5/2012 | Kincaid | F41C 33/0209 224/243 |
| 9,360,275 | B2 * | 6/2016 | de Nijs | F41C 33/04 |
| 2005/0035163 | A1 * | 2/2005 | French | F41C 33/045 224/243 |

(Continued)

*Primary Examiner* — Derek J Battisti
(74) *Attorney, Agent, or Firm* — Shaddock Law Group, PC

(57) ABSTRACT

An overmolded/through-molded holster, having one or more wall portions defining a holster body, wherein the holster body extends from a substantially open top portion to a bottom portion, and wherein the one or more wall portions define an at least partial holster cavity of the holster body; at least one overmold aperture formed through a portion of one or more of the one or more wall portions; and an overmolding material extending atop at least a portion of an exterior surface of the holster body, wherein at least a portion of the overmolding material extends through the at least one overmold aperture, such that at least a portion of the overmolding material extends through at least a portion of the at least one overmold aperture and into at least a portion of the at least partial holster cavity.

20 Claims, 7 Drawing Sheets

(56) References Cited

U.S. PATENT DOCUMENTS

| | | | | |
|---|---|---|---|---|
| 2006/0156525 | A1* | 7/2006 | Jenkins | F41C 33/0209 29/407.1 |
| 2006/0226185 | A1* | 10/2006 | Har-Shen | F41C 33/0263 224/244 |
| 2007/0181619 | A1 | 8/2007 | Seyfert et al. | |
| 2008/0105721 | A1 | 5/2008 | Har-Shen | |
| 2013/0327799 | A1 | 12/2013 | Sitz | |
| 2014/0103083 | A1* | 4/2014 | Sitz | F41C 33/0245 224/255 |
| 2015/0041507 | A1* | 2/2015 | Pellegrini | F41C 33/0272 224/193 |
| 2015/0197023 | A1* | 7/2015 | Prince | A45F 5/021 224/232 |
| 2015/0247701 | A1* | 9/2015 | Faifer | F41C 33/0209 224/244 |
| 2019/0293386 | A1* | 9/2019 | Smith | F41C 33/041 |

* cited by examiner

OVERMOLDED / THROUGH-MOLDED HOLSTER

CROSS-REFERENCE TO RELATED APPLICATIONS

This patent application claims the benefit of U.S. Patent Application Ser. No. 62/476,836, filed Mar. 26, 2017, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of holsters. More specifically, the presently disclosed systems, methods, and/or apparatuses relate to an overmolded/through-molded holster, adaptable to be used with a handgun or other firearm.

2. Description of Related Art

It is generally known to carry a handgun in a holster designed to protect the handgun and hold it securely. Holsters can be worn in a number of ways, such as on a belt at the waist, on the thigh, attached or coupled to a plate carrier or tactical vest, under an arm, or around an ankle.

In certain instances, a handgun must be secured or retained within the holster, but quickly and easily removed from the holster, regardless of the type of holster used. Additionally, users need to be assured that, when not in use, the handgun will remain safely in the holster.

Some holsters rely solely on frictional engagement between surfaces of the interior holster cavity of the holster and the handgun to secure the handgun within the holster cavity of the holster. Certain other holsters include a locking lever or mechanism, which secures the handgun within the holster until the locking lever or mechanism is manipulated to allow the handgun to be withdrawn from the holster.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, typical holster designs have various shortcomings. In certain holsters, the tolerance or fit between one or more of the interior surfaces of the holster cavity and an inserted handgun allows for a relatively high degree of play between the inserted handgun and the holster. Thus, the handgun is able to be shaken or wobble within the holster. If the degree of play between the inserted handgun and the holster is too great, the handgun may wobble a sufficient amount to slide by or avoid any locking lever or mechanism and unintentionally fall out of or be withdrawn from the holster.

Additionally, the material used to form the holster may have a relatively smooth or slick surface, which does not provide a desired level of frictional engagement between the interior of the holster and the outer surface of the inserted handgun.

In order to overcome these and other shortcomings of the currently known holster designs and/or to provide an improved holster, in various exemplary, non-limiting embodiments, the overmolded/through-molded holster of the present disclosure comprises one or more wall portions defining a holster body, wherein the holster body extends from a substantially open top portion to a bottom portion, and wherein the one or more wall portions define an at least partial holster cavity of the holster body; at least one overmold aperture formed through a portion of one or more of the one or more wall portions; and an overmolding material extending atop at least a portion of an exterior surface of the holster body, wherein at least a portion of the overmolding material extends through the at least one overmold aperture, such that at least a portion of the overmolding material extends through at least a portion of the at least one overmold aperture and into at least a portion of the at least partial holster cavity.

In various exemplary, nonlimiting embodiments, a longitudinal axis of the holster body extends generally from the top portion to the bottom portion.

In various exemplary, nonlimiting embodiments, the at least partial holster cavity includes a frame/slide portion and a trigger guard portion. In certain of the exemplary embodiments, a depth of the frame/slide portion is different from a depth of the trigger guard portion.

In various exemplary, nonlimiting embodiments, at least a portion of the at least partial holster cavity (or at least a portion of at least one of the one or more wall portions) is contoured to accommodate a specific type or model of handgun to be retained within the overmolded/through-molded holster.

In various exemplary, nonlimiting embodiments, the holster body is substantially rigid, while the overmolding material is substantially resilient. In certain exemplary embodiments, the overmolding material is formed of a rubber or silicone.

In various exemplary, nonlimiting embodiments, at least one overmold recess is formed in at least a portion of an exterior surface of the holster body. In these exemplary embodiments, the at least one overmold aperture is formed through a portion of one or more of the one or more wall portions within the overmold recess and the overmolding material extends within the overmold recess. In certain exemplary embodiments, one or more overmold recess ridge segments extend from at least a portion of the exterior surface of the holster body to define the overmold recess.

In various exemplary, non-limiting embodiments, the present disclosure provides an overmolded/through-molded holder, including one or more wall portions defining a holder body portion, wherein the holder body portion extends from a substantially open top portion to a bottom portion, and wherein the one or more wall portions define an at least partial holder cavity of the holder body portion; at least one overmold aperture formed through a portion of one or more of the one or more wall portions; and an overmolding material extending atop at least a portion of an exterior surface of the holder body portion, wherein at least a portion of the overmolding material extends through the at least one overmold aperture, such that at least a portion of the overmolding material extends through at least a portion of the at least one overmold aperture and into at least a portion of the at least partial holder cavity.

In various exemplary, non-limiting embodiments, the present disclosure provides a method for producing an overmolded/through-molded holder, comprising providing one or more wall portions defining a holder body portion, wherein the one or more wall portions define an at least partial holder cavity of the holder body portion, and wherein at least one overmold aperture is formed through a portion of one or more of the one or more wall portions; and providing an overmolding material atop at least a portion of an exterior surface of the holder body portion, wherein at least a portion of the overmolding material extends through the at least one overmold aperture as one or more through-body protrusions, wherein each through-body protrusion extends through at least a portion of the at least one overmold aperture and into at least a portion of the at least partial holder cavity.

Accordingly, the overmolded/through-molded holster of the present disclosure separately and optionally provides a handgun holster having an at least partially overmolded surface.

The overmolded/through-molded holster of the present disclosure separately and optionally provides a handgun holster having one or more through-body protrusions, which extend into an at least partial holster cavity from an at least partially overmolded surface.

The overmolded/through-molded holster of the present disclosure separately and optionally provides a handgun holster, which reduces or eliminates wobble or play between portions of the at least partial holster cavity and a handgun seated within the at least partial holster cavity.

The overmolded/through-molded holster of the present disclosure separately and optionally provides a handgun holster, which is able to accommodate a variety of styles or types of handgun within a given holster.

The presently disclosed systems, methods, and/or apparatuses separately and optionally provide an overmolded/through-molded holster that can be manufactured to accommodate a variety of handguns.

The presently disclosed systems, methods, and/or apparatuses separately and optionally provide an overmolded/through-molded holster that can provide multiple exterior options for a single holster body.

The presently disclosed systems, methods, and/or apparatuses separately and optionally provide an overmolded/through-molded holster that can provide multiple interior cavity options for a single holster body.

The presently disclosed systems, methods, and/or apparatuses separately and optionally provide an overmolded/through-molded holder that can be manufactured to accommodate a variety of items.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

c

Figure 1:
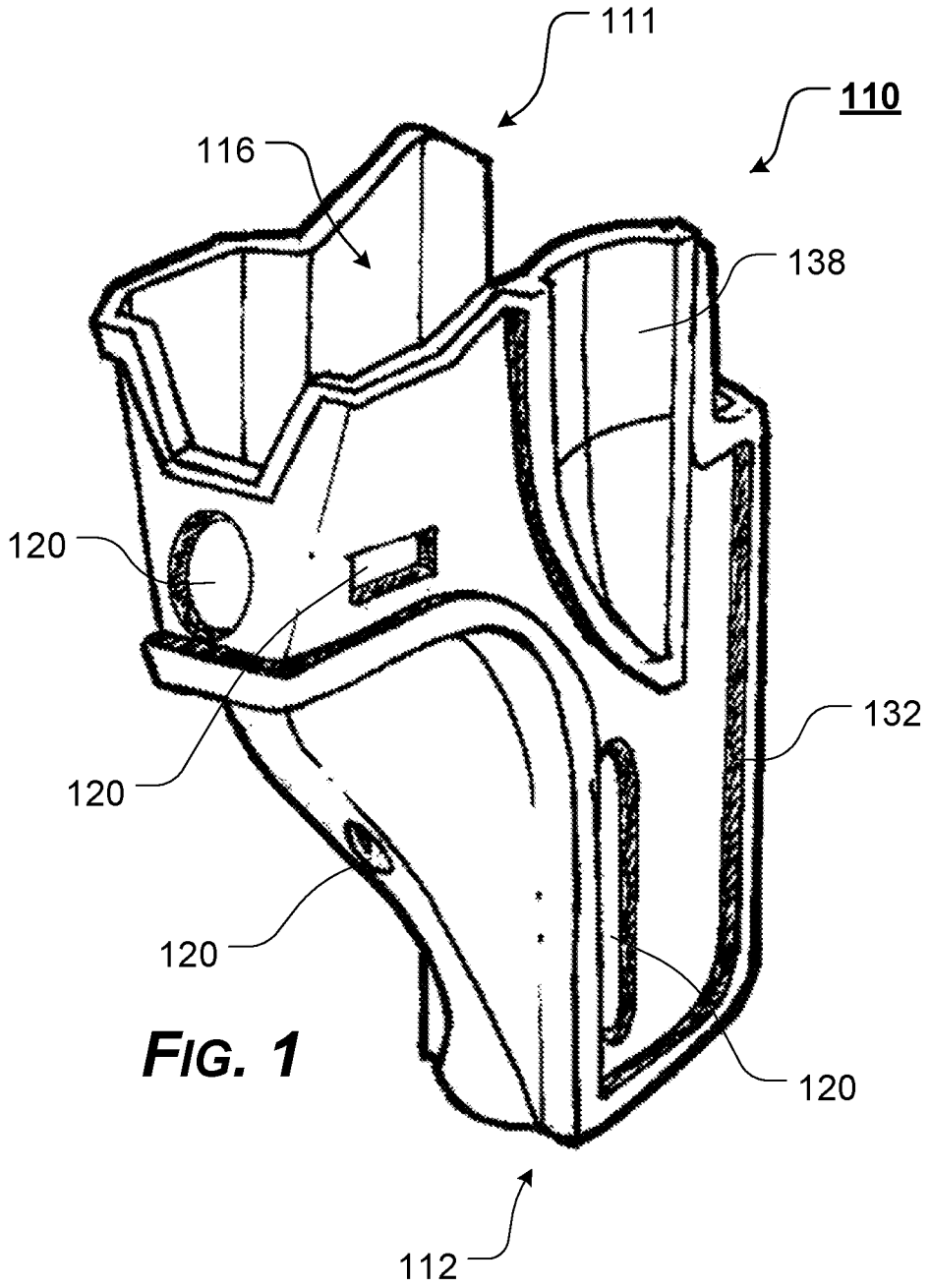
FIG. 1 illustrates a rear perspective view of an exemplary embodiment of a holster body, according to the presently disclosed systems, methods, and/or apparatuses.
Figure 2:
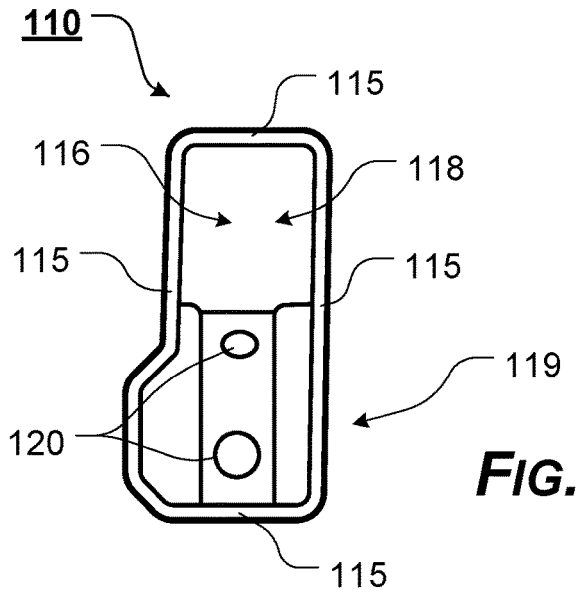
FIG. 2 illustrates a top view of an exemplary embodiment of a holster body, according to the presently disclosed systems, methods, and/or apparatuses.
Figure 3:
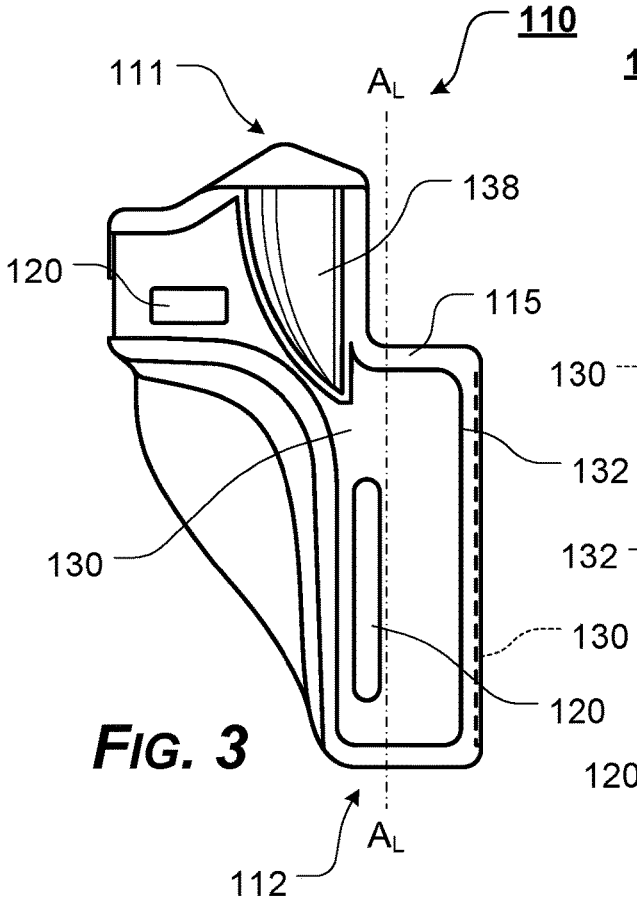
FIG. 3 illustrates a right side view of an exemplary embodiment of a holster body, according to the presently disclosed systems, methods, and/or apparatuses.
Figure 4:
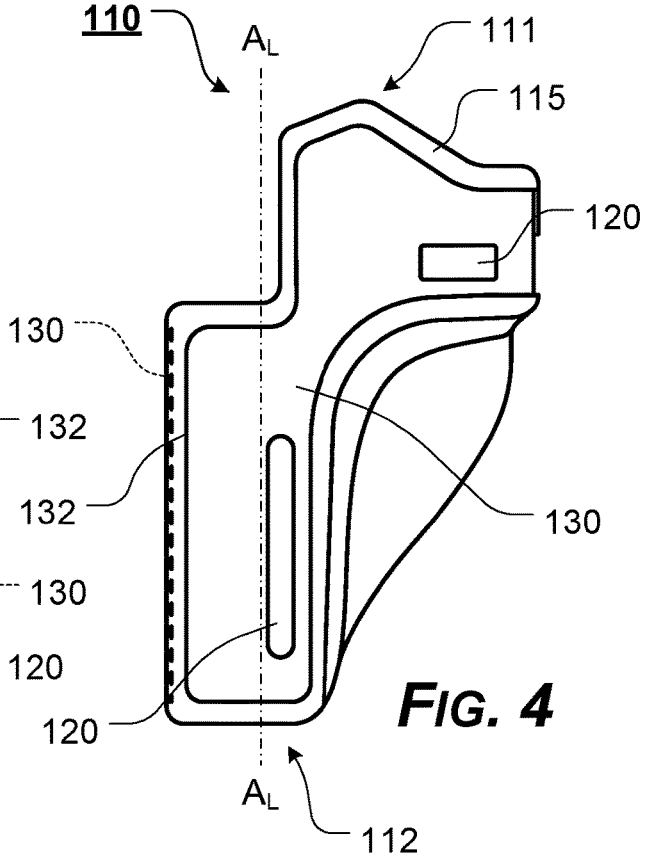
FIG. 4 illustrates a left side view of an exemplary embodiment of a holster body, according to the presently disclosed systems, methods, and/or apparatuses.
Figure 5:
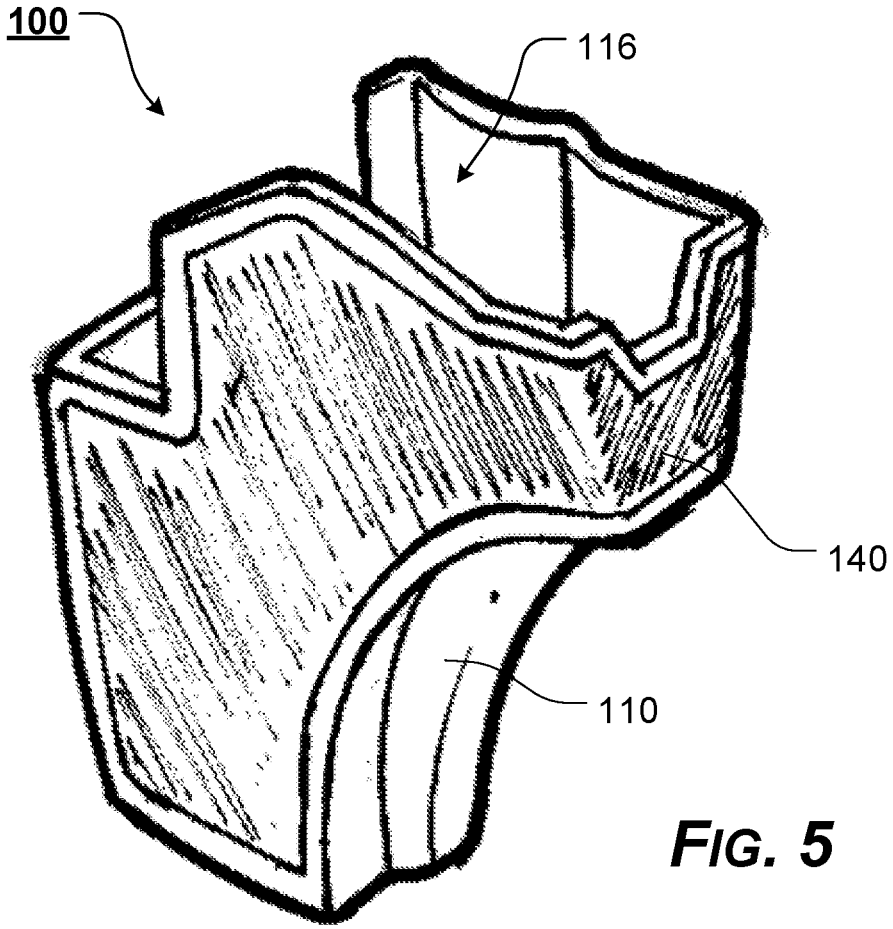
FIG. 5 illustrates an upper, rear, perspective view of an exemplary embodiment of an overmolded/through-molded holster, according to the presently disclosed systems, methods, and/or apparatuses.
Figure 6:
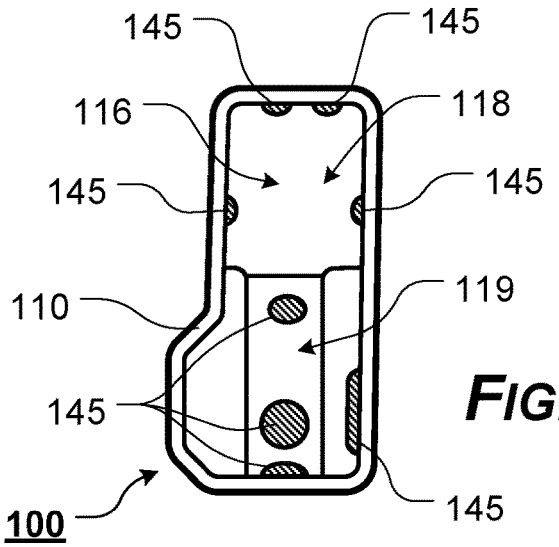
Figure 7:
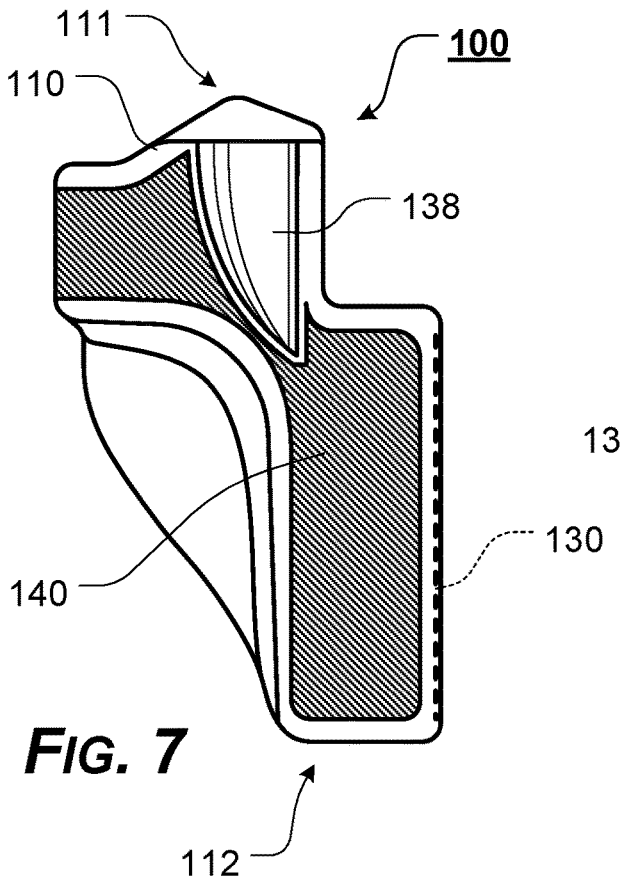
Figure 8:
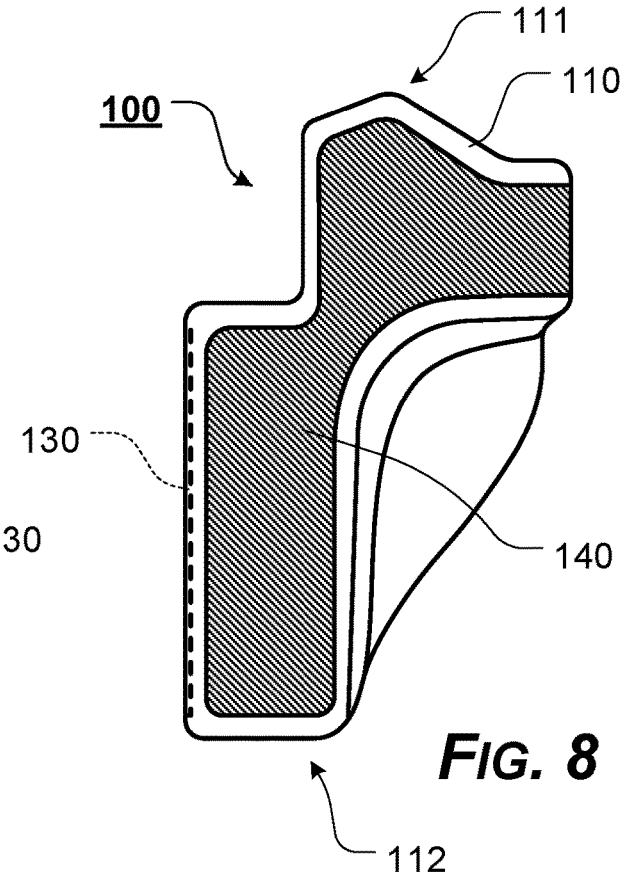
Figure 9:
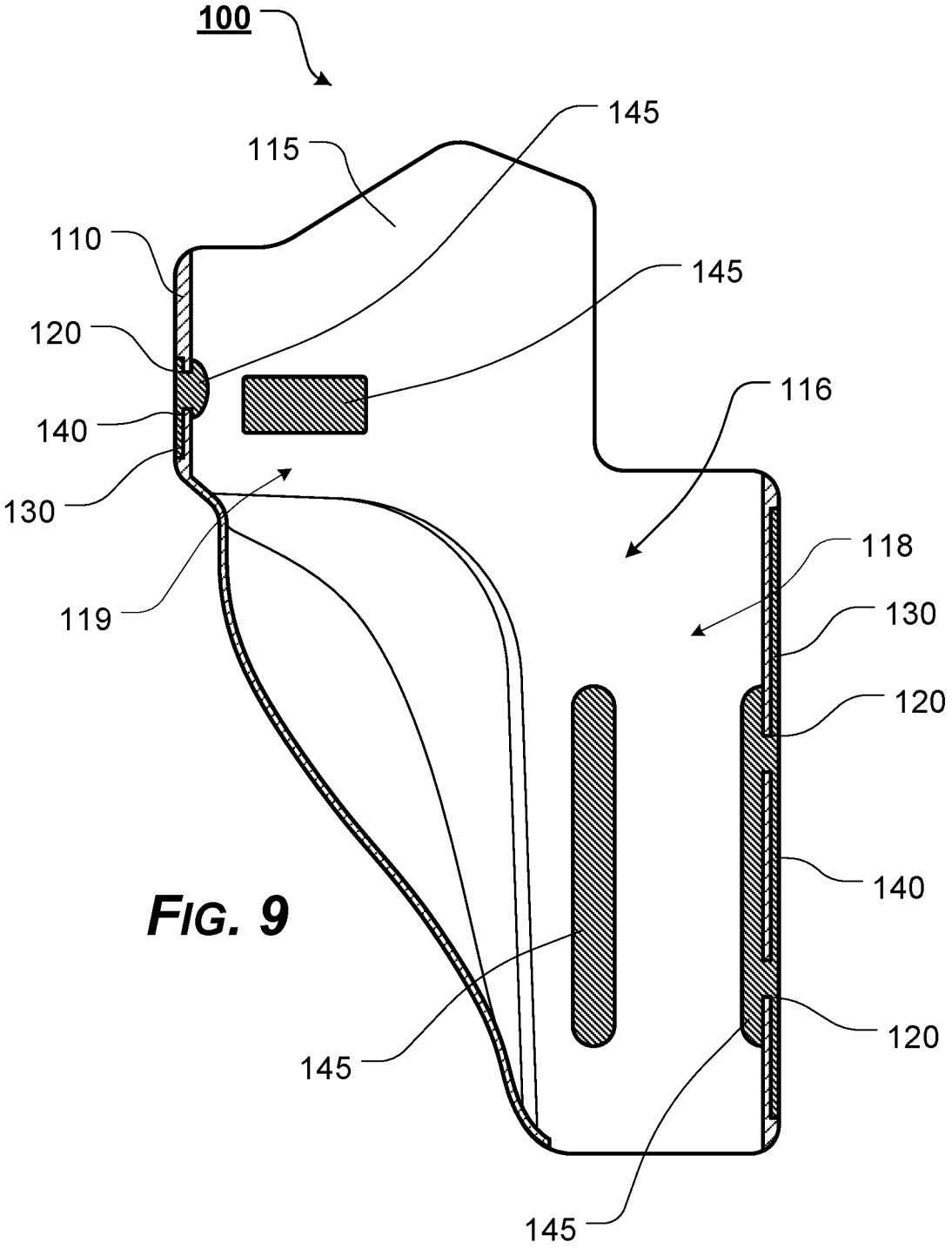
Figure 10:
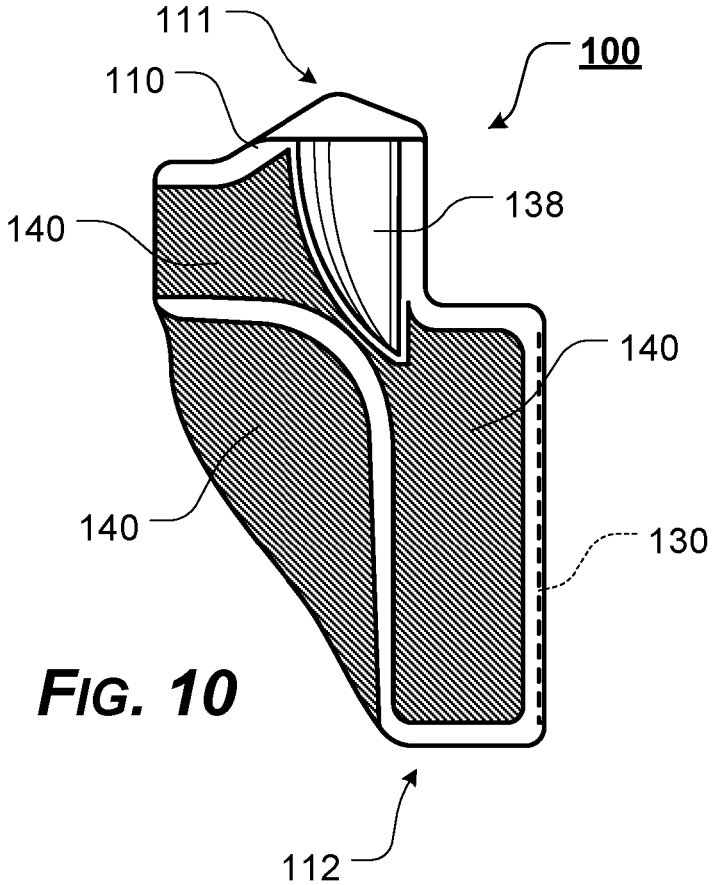
Figure 11:
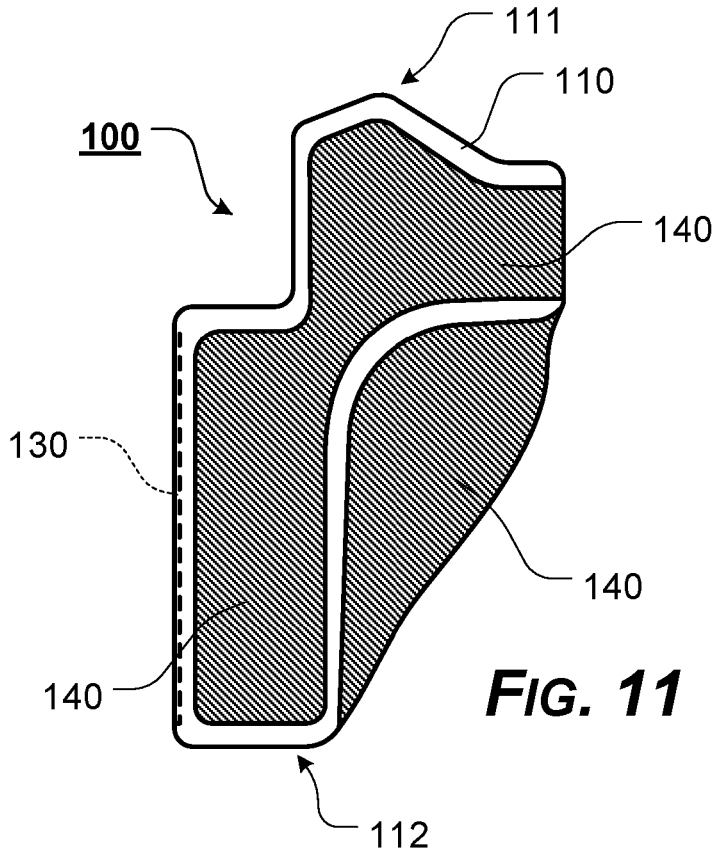
Figure 12:
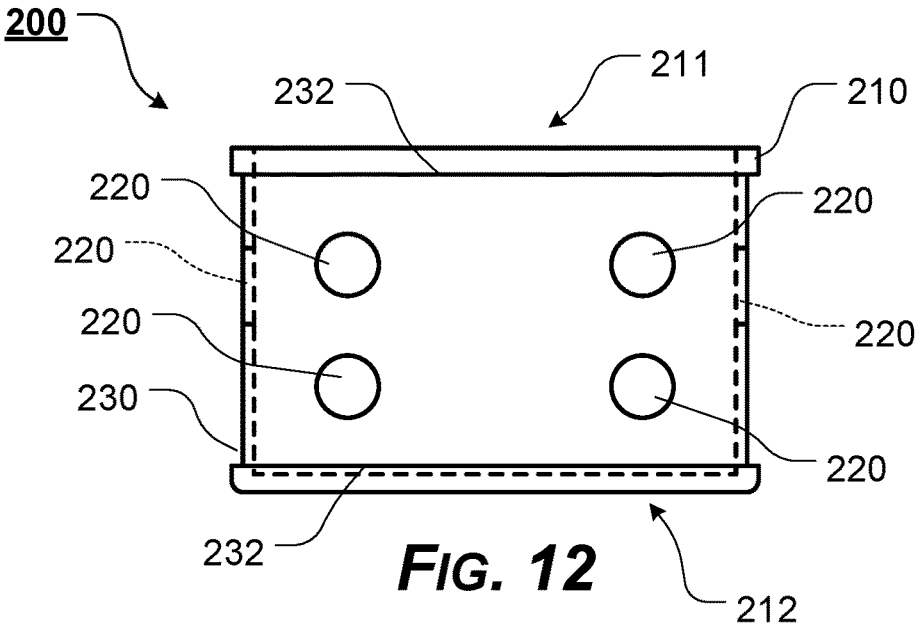
Figure 13:
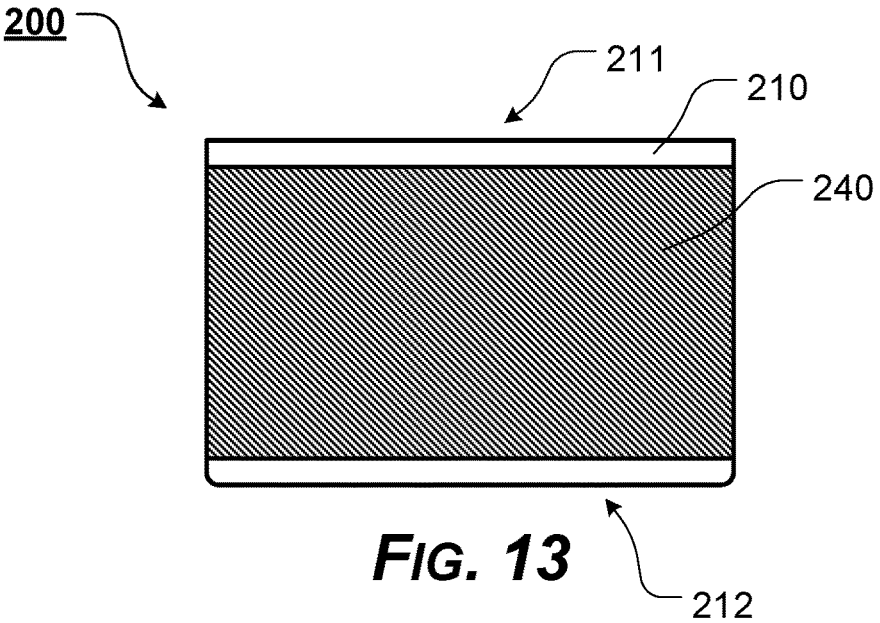
Figure 14:
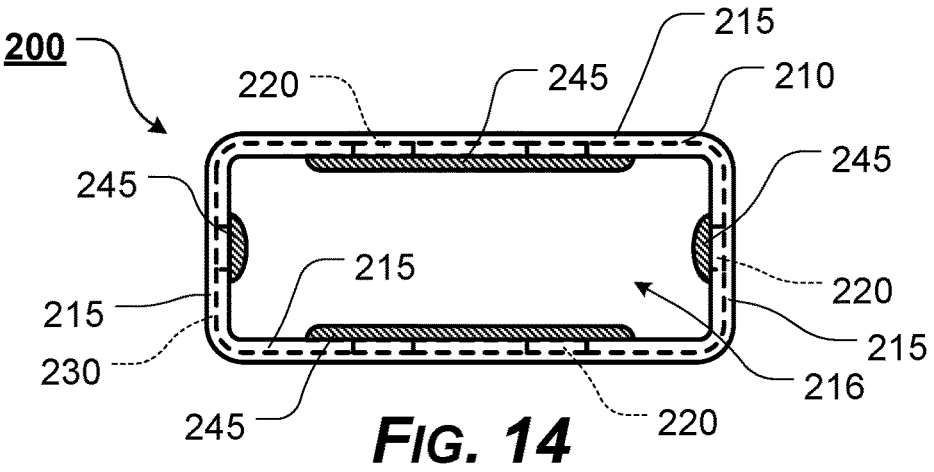

FIG. 7 illustrates a right side view of an exemplary embodiment of an overmolded/through-molded holster, according to the presently disclosed systems, methods, and/or apparatuses;

FIG. 8 illustrates a left side view of an exemplary embodiment of an overmolded/through-molded holster, according to the presently disclosed systems, methods, and/or apparatuses;

FIG. 9 illustrates a right side, cross-sectional view of an exemplary embodiment of an overmolded/through-molded holster, according to the presently disclosed systems, methods, and/or apparatuses;

FIG. 10 illustrates a right side view of an exemplary embodiment of an overmolded/through-molded holster, according to the presently disclosed systems, methods, and/or apparatuses;

FIG. 11 illustrates a left side view of an exemplary embodiment of an overmolded/through-molded holster, according to the presently disclosed systems, methods, and/or apparatuses;

FIG. 12 illustrates a right side view of an exemplary embodiment of a holster body, according to the presently disclosed systems, methods, and/or apparatuses;

FIG. 13 illustrates a right side view of an exemplary embodiment of an overmolded/through-molded holster, according to the presently disclosed systems, methods, and/or apparatuses; and FIG. 14 illustrates a top view of an exemplary embodiment of an overmolded/through-molded holster, according to the presently disclosed systems, methods, and/or apparatuses.

DETAILED DESCRIPTION OF EXEMPLARY EMBODIMENTS OF THE PRESENT DISCLOSURE

For simplicity and clarification, the design factors and operating principles of the overmolded/through-molded holster according to the presently disclosed systems, methods, and/or apparatuses are explained with reference to various exemplary embodiments of an overmolded/through-molded holster according to the presently disclosed systems, methods, and/or apparatuses. The basic explanation of the design factors and operating principles of the overmolded/through-molded holster is applicable for the understanding, design, and operation of the overmolded/through-molded holster of the presently disclosed systems, methods, and/or apparatuses. It should be appreciated that the overmolded/through-molded holster can be adapted to many applications where a holster can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "overmolded/through-molded" and "holster" are used for a basic explanation and understanding of the operation of the systems, methods, and apparatuses of the present disclosure. Therefore, the terms "overmolded/through-molded" and "holster" are not to be construed as limiting the systems, methods, and apparatuses of the present disclosure.

Furthermore, it should be appreciated that, for simplicity and clarification, the embodiments of the present disclosure will be described with reference to a semiautomatic-type handgun being utilized in conjunction with the overmolded/through-molded holster of the present disclosure. However, it should be appreciated that the operating principles of the disclosed overmolded/through-molded holster may also be employed to construct overmolded/through-molded holsters or holders for any revolver or semiautomatic-type handgun, edged weapon, and/or less than lethal product (i.e., tasers, pepper spray, mace canisters, or batons). Furthermore, it is also within the scope of the present disclosure that the present overmolded/through-molded holster may be employed as a holster or holder for tactical accessories, such as ammunition magazines and/or flashlights, as well as for everyday items such as cell phones or personal digital assistants.

Turning now to the appended drawing figures, FIGS. 1-11 illustrate certain elements and/or aspects of an overmolded/through-molded holster 100 according to the present disclosure, while FIGS. 12-14 illustrate certain elements and/or aspects of an overmolded/through-molded holder 200 according to the present disclosure.

It should be appreciated that, by way of illustration and not limitation, the overmolded/through-molded holster 100 is illustrated as being adapted to retain a semiautomatic-type handgun. The semiautomatic-type handgun generally includes a slide portion and a frame portion. The frame portion generally includes a dust cover, a grip, a trigger guard, and a trigger. The trigger guard includes an inner surface, which defines an area wherein the trigger is located and allows a user's finger access to the trigger, and an outer surface, which defines the outer perimeter of the trigger guard.

In illustrative, non-limiting embodiment(s) of the presently disclosed systems, methods, and/or apparatuses, as illustrated in FIGS. 1-11, the illustrated, exemplary overmolded/through-molded holster 100 includes a holster body 110 defining an at least partial holster cavity 116 for receiving and holding the handgun. In various exemplary embodiments, one or more wall portions 115 define the holster body 110. The holster body 110 extends from a substantially open top portion 111 to a bottom portion 112. In these exemplary embodiments, the one or more wall portions 115 define the at least partial holster cavity 116 of the holster body 110.

In various exemplary, nonlimiting embodiments, the holster body 110 is formed from a first side wall portion, a second side wall portion, a front wall portion, and a rear wall portion.

However, it should be appreciated that the overmolded/through-molded holster 100 may be formed such that one or more wall portions 115 define the at least partial holster cavity 116 for receiving the handgun. In these exemplary embodiments, the at least partial holster cavity 116 may be formed from any number or combination of sidewalls, side, front, and/or rear walls, or wall portions 115, including, for example, a single, continuous wall portion 115 or multiple coupled or joined wall portions 115. Thus, the at least partial holster cavity 116 may be formed by any holster cavity 116, partial holster cavity 116, space, or platform that is capable of retaining a portion of a handgun.

In certain exemplary, nonlimiting embodiments, the holster body 110 merely comprises a single wall portion 115, such as, for example, the first wall portion 115. Any remaining portions of the overmolded/through-molded holster 100 may be attached, coupled, or formed as a portion or extension of the holster body 110.

In certain exemplary, nonlimiting embodiments, as illustrated, the holster body 110 and/or the at least partial holster cavity 116 includes a frame/slide portion 118. At least a portion of the frame/slide portion 118 is shaped so as to receive and accommodate at least a portion of the frame and/or slide of an inserted handgun. In various exemplary embodiments, the frame/slide portion 118 is generally formed by a portion of the holster body 110 of the overmolded/through-molded holster 100. The frame/slide portion 118 is shaped generally to match the contours of at least a portion of the outer surface of the frame and/or slide of a handgun to be inserted within the at least partial holster cavity 116. The frame/slide portion 118 is formed so as to contact at least a portion of the outer surface of the frame and/or slide of the inserted handgun and at least partially limit movement of a handgun, when the handgun is inserted into the overmolded/through-molded holster 100.

In certain exemplary, nonlimiting embodiments, as illustrated, the holster body 110 and/or the at least partial holster cavity 116 includes a trigger guard portion 119. At least a portion of the trigger guard portion 119 is shaped so as to receive and accommodate at least a portion of the trigger guard of an inserted handgun. In various exemplary embodiments, the trigger guard portion 119 is generally formed by a portion of the holster body 110 of the overmolded/through-molded holster 100. The trigger guard portion 119 is shaped generally to match the contours of at least a portion of the outer surface of the trigger guard. The trigger guard portion 119 is formed so as to contact at least a portion of the outer surface of the trigger guard of the inserted handgun and further limit how far the handgun can be inserted into the overmolded/through-molded holster 100.

It should be noted that the wall portions 115 of the holster body 110 may generally be planar. Alternatively, the wall portions 115 of the holster body 110 may be contoured or shaped to better accommodate a specific type or model of handgun to be retained within the overmolded/through-molded holster 100.

In various exemplary embodiments, a finger trough 138 is formed in at least one of the wall portions 115, so as to further aid in the proper placement of a user's finger on the overmolded/through-molded holster 100. The finger trough 138, if included, is formed and positioned such that, as the user grips an inserted handgun, the user's index, or other, finger is positioned along the frame of the handgun, between the trigger guard and the slide. Therefore, as the handgun is withdrawn from the overmolded/through-molded holster 100, the user's index finger is positioned to contact the frame of the handgun, above the trigger guard, and not in or on the trigger guard or the trigger. The finger trough 138 may optionally include a textured portion (not shown), such that the finger trough 138 may be distinguished tactilely from other portions of the overmolded/through-molded holster 100.

In various exemplary embodiments, the overmolded/through-molded holster 100 optionally includes at least one holster frame attachment portion, which provides an area or device for fastening the overmolded/through-molded holster 100 to a holster holding device. Alternatively, the means for holster frame attachment portion may comprise a clip or hook adapted to, for example, be clipped over or to a belt. In further exemplary embodiments, the holster frame attachment portion may comprise one or more quick-disconnect or other couplings, which may be permanently or removably coupled to corresponding and cooperating coupling(s) provided on a belt or other carrier or platform. In still other exemplary embodiments, the overmolded/through-molded holster 100 may comprise an integral belt, or may comprise one or more connections for attachment to a chest, ankle, leg, shoulder, or other harness or band, or for otherwise securing the overmolded/through-molded holster 100 to a user or the user's apparel.

In various exemplary embodiments, the holster body 110 is substantially rigid and is formed of a polymeric material such as a polymeric composite. Thus, the holster body 110 provides a skeleton or platform for the overmolding material 140 (which provides texture or shape to at least a portion of the exterior of the overmolded/through-molded holster 100) and the through-body protrusion 145 (which provide shape, interior dimensioning, and frictional engagement areas for the at least partial holster cavity 116 of the overmolded/through-molded holster 100).

Alternate materials of construction of the holster body 110 may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the holster body 110 are generally substantially rigid, but are a design choice based on the desired appearance and functionality of the overmolded/through-molded holster 100.

In various exemplary, nonlimiting embodiments, a longitudinal axis, $A_L$, of the holster body 110 extends generally from the top portion 111 to the bottom portion 112.

In various exemplary, nonlimiting embodiments, the at least partial holster cavity 116 includes a frame/slide portion 118 and a trigger guard portion 119. In certain of the exemplary embodiments, a depth of the frame/slide portion 118 is different from a depth of the trigger guard portion 119.

In various exemplary, nonlimiting embodiments, at least a portion of the at least partial holster cavity 116 (or at least a portion of at least one of the one or more wall portions 115) is contoured to accommodate a specific type or model of handgun to be retained within the c.

At least one overmold aperture 120 is formed through a portion of one or more of the wall portions 115. As illustrated, a plurality of overmold apertures 120 may be formed through one or more portions of one or more of the wall portions 115. The number, size, shape, and placement of the overmold apertures 120 is a design choice. Each overmold aperture 120 allows at least some of an overmolding material 140 to extend through the overmold aperture 120, such that at least a portion of the overmolding material 140 extends through at least a portion of the at least one overmold aperture 120 and into at least a portion of the at least partial holster cavity 116.

In various exemplary, nonlimiting embodiments, at least one overmold recess 130 is formed in at least a portion of an exterior surface of the holster body 110. In these exemplary embodiments, the at least one overmold aperture 120 is formed through a portion of one or more of the one or more wall portions 115 within the overmold recess 130 and the overmolding material 140 extends within the overmold recess 130. In certain exemplary embodiments, one or more overmold recess ridge segments 132 extend from at least a portion of the exterior surface of the holster body 110 to define the overmold recess 130.

It should be appreciated that the overmold recesses 130, formed by the overmold recess ridge segments 132 are optional and the overmolding material 140 may be applied so as to extend atop a portion of an exterior surface of the holster body 110.

The overmolding material 140 extends atop at least a portion of an exterior surface of the holster body 110. The overmolding material 140 is attached or coupled to at least a portion of the exterior surface of the holster body 110 as an additional layer of material over at least a portion of the exterior surface of the holster body 110. If the overmold recess 130 is included, the overmolding material 140 is added as an additional layer of material over at least an exterior surface of the holster body 110 and optionally within the overmold recess 130.

In various exemplary embodiments, the overmolding material 140 is attached by chemical or adhesive attachment, wherein a portion of the exterior surface of the holster body 110 is coated with an adhesive and the overmolding material 140 is affixed to the exterior surface of the holster body 110, via the adhesive. In certain exemplary embodiments, at least a portion of the exterior surface of the holster body 110 may be scored or altered with surface projections, recesses, or other preparations to provide better attachment or coupling between the exterior surface of the holster body 110 and the overmolding material 140.

In various exemplary, nonlimiting embodiments, the overmolding material 140 may comprise an at least partially resilient material such as silicon or vulcanized rubber. In this manner, the overmolding material 140 may not only provide a degree of cushion to portions of the exterior of the holster body 110, but also provide releasable frictional engagement to a holster positioned within the holster cavity 116.

In various exemplary embodiments, the surface of the overmolding material 140 may be textured or include tactile variations to provide an ornamental appearance to the overmolding material 140 or tactile recognition of various components or elements of the overmolded/through-molded holster 100.

Through application of the overmolding material 140, at least a portion of the overmolding material 140 optionally extends through each of the overmold apertures 120, to form a through-body protrusion 145. Each through-body protrusion 145 optionally extends through one or more overmold aperture 120, into at least a portion of the at least partial holster cavity 116.

By having at least a portion of the overmolding material 140 extend into or through each of the overmold apertures 120, the overmolding material 140 is further anchored or tethered to the holster body 110.

Each through-body protrusion 145 may optionally extend a desired amount into or through each overmold aperture 120. For example, one or more through-body protrusions 145 may only extend partially into a respective overmold aperture 120. One or more through-body protrusions 145 may extend completely through a respective overmold aperture 120, while not extending past the adjacent wall portion 115 or into the holster cavity 116. Alternatively, one or more through body protrusions 145 may extend completely through a respective overmold aperture 120 and into at least a portion of the holster cavity 116. If a respective through-body protrusion 145 extends into at least a portion of the holster cavity 116, the through-body protrusion 145 may extend so as to have sidewalls that are substantially parallel to the respective overmold aperture 120. Alternatively, the through-body protrusion 145 may extend so as to extend beyond or mushroom beyond the respective overmold aperture 120.

The thickness, texture, and resilience of the overmolding material 140 may be varied, based upon the desired level of resilient interaction or tension provided by the through-body protrusions 145, relative to the at least partial holster cavity 116 and/or surfaces of an inserted handgun. By varying the material used to form the overmolding material 140 (which allows for variations in thickness, texture, and/or resilience of the overmolding material 140), the degree to which each through-body protrusion 145 extends into the at least partial holster cavity 116 may be determined or controlled. Additionally, by varying the material used to form the overmolding material 140, a degree of frictional tension or frictional engagement between the through-body protrusions 145 and a handgun positioned within the at least partial holster cavity 116 can be determined or controlled.

In various exemplary, nonlimiting embodiments, the holster body 110 is substantially rigid, while the overmolding material 140 is substantially resilient. In certain exemplary embodiments, the overmolding material 140 is formed of a rubber or silicone.

In certain exemplary, nonlimiting embodiments, during formation of the overmolded/through-molded holster 100, the holster body 110 is first formed or created. For example, the holster body 110 may be formed by, for example, injection molding, 3D printing, milling, forming, or may be formed of layers of carbon fiber or other material.

Once the holster body 110 is formed, it can be placed in a mold and the overmolding material 140 can be formed outside of and around at least a portion of the holster body 110. The material of the overmolding material 140 is injected or otherwise molded so that various through-body protrusion 145 are formed or extruded into, partially through, or completely through various overmold apertures 120.

In certain exemplary embodiments, because at least a portion of the overmolding material 140 is formed through the overmold apertures 120 and into the holster cavity 116, a variety of overmolded/through-molded holsters 100 can be formed having a substantially similar exterior, but with differing internal dimensions for the holster cavity 116.

For example, a single outer mold may be used to form the overmolding material 140 to the holster body 110, while a variety of different mold inserts can be utilized to create the holster cavity 116. As the overmolding material 140 from outside the holster body 110 flows through the overmold apertures 120 and into the holster cavity 116, the selected mold insert can dictate the size, shape, and/or internal dimensions of the holster cavity 116. Thus, overmolded/through-molded holsters 100 having a substantially similar exterior can be created for various firearms or devices.

In this manner, a single type or style of holster body 110 may optionally be utilized to accommodate a variety of patterns of overmolding material 140 and/or through-body protrusions 145. For example, by varying the size, number, and/or placement of through-body protrusions 145 within the holster cavity 116, the holster body 110 may be utilized to create an overmolded/through-molded holster 100, which can accommodate a number of different handgun types.

Thus, the amount of tooling required to produce a wide variety of overmolded/through-molded holsters 100 is greatly reduced, when compared to the amount of tooling required to produce known holsters.

During use of the overmolded/through-molded holster 100, as a handgun is inserted into the at least partial holster cavity 116 of the overmolded/through-molded holster 100, muzzle first, the handgun is guided into position by at least some portion of the overmolded/through-molded holster 100, such as, for example, the a wall portion 115 of the holster cavity 116.

As the handgun is inserted further into the at least partial holster cavity 116, at least a portion of outer surface of the handgun (whether a portion of the trigger guard or the frame/slide) will slide adjacent or against one or more of the through-body protrusions 145.

As the handgun is fully seated into the overmolded/through-molded holster 100, at least a portion of the outer surface of the handgun will be positioned against or adjacent one or more of the through-body protrusions 145. Contact between one or more of the outer surfaces of the handgun and the one or more through-body protrusions 145 provides a compressive force or frictional tension to "squeeze" at least portions of the handgun within the at least partial holster cavity 116. This results in a relatively secure, wiggle or movement free gripping of the handgun within the overmolded/through-molded holster 100.

In various exemplary embodiments, the overmold apertures 120 and resultant through-body protrusions 145 may be positioned within one or more of the trigger guard portion 119 or the frame/slide portion 118 to contact one or more of the trigger guard or frame/slide of an inserted handgun. The overmold apertures 120 and the resultant through-body protrusions 145 may also be positioned so as to contact one or more surfaces of an accessory attached or coupled to the handgun, such as for example, an illumination or laser projection device.

Similarly, FIGS. 22-14 illustrate certain elements and/or aspects of an overmolded/through-molded holder 200 according to the present disclosure.

It should be understood that the elements of the overmolded/through-molded holder 200 correspond substantially to and operates similarly to the similarly named and numbered elements of the overmolded/through-molded holster 100 of FIGS. 1-11.

In various illustrative, non-limiting embodiment(s) of the presently disclosed systems, methods, and/or apparatuses, the illustrated, exemplary overmolded/through-molded holder 200 includes a holder body 210 having one or more wall portions 215 defining the holder body 210 and an at least partial holder cavity 216 for receiving and holding an item, such as, for example, a firearm magazine. The holder body 210 extends from a substantially open top portion 211 to a bottom portion 212.

In various exemplary embodiments, the overmolded/through-molded holder 200 optionally includes at least one holder frame attachment portion, which provides an area or device for fastening the overmolded/through-molded holder 200 to a holder holding device.

In various exemplary embodiments, the holder body 210 is substantially rigid and is formed of a polymeric material such as a polymeric composite. Thus, the holder body 210 provides a skeleton or platform for the overmolding material 240 (which provides texture or shape to at least a portion of the exterior of the overmolded/through-molded holder 200) and the through-body protrusion 245 (which provide shape, interior dimensioning, and frictional engagement areas for the at least partial holder cavity 216 of the overmolded/through-molded holder 200).

Thus, it should be understood that the material or materials used to form the holder body 210 are generally substantially rigid, but are a design choice based on the desired appearance and functionality of the overmolded/through-molded holder 200.

At least one overmold aperture 220 is formed through a portion of one or more of the wall portions 215. As illustrated, a plurality of overmold apertures 220 may be formed through one or more portions of one or more of the wall portions 215. The number, size, shape, and placement of the overmold apertures 220 is a design choice. Each overmold aperture 220 allows at least some of an overmolding material 240 to extend through the overmold aperture 220, such that at least a portion of the overmolding material 240 extends through at least a portion of the at least one overmold aperture 220 and into at least a portion of the at least partial holder cavity 216.

In various exemplary, nonlimiting embodiments, at least one overmold recess 230 is formed in at least a portion of an exterior surface of the holder body 210. In these exemplary embodiments, the at least one overmold aperture 220 is formed through a portion of one or more of the one or more wall portions 215 within the overmold recess 230 and the overmolding material 240 extends within the overmold recess 230. In certain exemplary embodiments, one or more overmold recess ridge segments 232 extend from at least a portion of the exterior surface of the holder body 210 to define the overmold recess 230.

It should be appreciated that the overmold recesses 230, formed by the overmold recess ridge segments 232 are optional and the overmolding material 240 may be applied so as to extend atop a portion of an exterior surface of the holder body 210.

The overmolding material 240 extends atop at least a portion of an exterior surface of the holder body 210. The overmolding material 240 is attached or coupled to at least a portion of the exterior surface of the holder body 210 as an additional layer of material over at least a portion of the exterior surface of the holder body 210. If the overmold recess 230 is included, the overmolding material 240 is added as an additional layer of material over at least an exterior surface of the holder body 210 and optionally within the overmold recess 230.

In various exemplary, nonlimiting embodiments, the overmolding material 240 may comprise an at least partially resilient material such as silicon or vulcanized rubber. In this manner, the overmolding material 240 may not only provide a degree of cushion to portions of the exterior of the holder body 210, but also provide releasable frictional engagement to a holder positioned within the holder cavity 216.

In various exemplary embodiments, the surface of the overmolding material 240 may be textured or include tactile variations to provide an ornamental appearance to the overmolding material 240 or tactile recognition of various components or elements of the overmolded/through-molded holder 200.

Through application of the overmolding material 240, at least a portion of the overmolding material 240 optionally extends through each of the overmold apertures 220, to form a through-body protrusion 245. Each through-body protrusion 245 optionally extends through one or more overmold aperture 220, into at least a portion of the at least partial holder cavity 216.

By having at least a portion of the overmolding material 240 extend into or through each of the overmold apertures 220, the overmolding material 240 is further anchored or tethered to the holder body 210.

Each through-body protrusion 245 may optionally extend a desired amount into or through each overmold aperture 220. For example, one or more through-body protrusions 245 may only extend partially into a respective overmold aperture 220. One or more through-body protrusions 245 may extend completely through a respective overmold aperture 220, while not extending past the adjacent wall portion 215 or into the holder cavity 216. Alternatively, one or more through body protrusions 245 may extend completely through a respective overmold aperture 220 and into at least a portion of the holder cavity 216. If a respective through-body protrusion 245 extends into at least a portion of the holder cavity 216, the through-body protrusion 245 may extend so as to have sidewalls that are substantially parallel to the respective overmold aperture 220. Alternatively, the through-body protrusion 245 may extend so as to extend beyond or mushroom beyond the respective overmold aperture 220.

The thickness, texture, and resilience of the overmolding material 240 may be varied, based upon the desired level of resilient interaction or tension provided by the through-body protrusions 245, relative to the at least partial holder cavity 216 and/or surfaces of an inserted handgun. By varying the material used to form the overmolding material 240 (which allows for variations in thickness, texture, and/or resilience of the overmolding material 240), the degree to which each through-body protrusion 245 extends into the at least partial holder cavity 216 may be determined or controlled. Additionally, by varying the material used to form the overmolding material 240, a degree of frictional tension or frictional engagement between the through-body protrusions 245 and a handgun positioned within the at least partial holder cavity 216 can be determined or controlled.

In various exemplary, nonlimiting embodiments, the holder body 210 is substantially rigid, while the overmolding material 240 is substantially resilient. In certain exemplary embodiments, the overmolding material 240 is formed of a rubber or silicone.

In certain exemplary, nonlimiting embodiments, during formation of the overmolded/through-molded holder 200, the holder body 210 is first formed or created. For example, the holder body 210 may be formed by, for example, injection molding, 3D printing, milling, forming, or may be formed of layers of carbon fiber or other material.

Once the holder body 210 is formed, it can be placed in a mold and the overmolding material 240 can be formed outside of and around at least a portion of the holder body 210. The material of the overmolding material 240 is injected or otherwise molded so that various through-body protrusion 245 are formed or extruded into, partially through, or completely through various overmold apertures 220.

In certain exemplary embodiments, because at least a portion of the overmolding material 240 is formed through the overmold apertures 220 and into the holder cavity 216, a variety of overmolded/through-molded holders 200 can be formed having a substantially similar exterior, but with differing internal dimensions for the holder cavity 216.

For example, a single outer mold may be used to form the overmolding material 240 to the holder body 210, while a variety of different mold inserts can be utilized to create the holder cavity 216. As the overmolding material 240 from outside the holder body 210 flows through the overmold apertures 220 and into the holder cavity 216, the selected mold insert can dictate the size, shape, and/or internal dimensions of the holder cavity 216. Thus, overmolded/through-molded holders 200 having a substantially similar exterior can be created for various firearms or devices.

In this manner, a single type or style of holder body 210 may optionally be utilized to accommodate a variety of patterns of overmolding material 240 and/or through-body protrusions 245. For example, by varying the size, number, and/or placement of through-body protrusions 245 within the holder cavity 216, the holder body 210 may be utilized to create an overmolded/through-molded holder 200, which can accommodate a number of different items.

Thus, the amount of tooling required to produce a wide variety of overmolded/through-molded holders 200 is greatly reduced, when compared to the amount of tooling required to produce known holders.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An overmolded/through-molded holster, comprising:

a holster body, wherein said holster body extends from an open top portion to a bottom portion, and wherein one or more wall portions define an at least partial holster cavity of said holster body;

a plurality of overmold apertures formed through one or more of said one or more wall portions; and an overmolding material molded atop at least a portion of an exterior surface of said holster body as an additional layer of material molded atop said portion of said exterior surface of said holster body, wherein an integrally formed portion of said overmolding material extends through at least a portion of each of said plurality of overmold apertures, such that a portion of said overmolding material extends through at least a portion of each of said plurality of overmold apertures to form a plurality of respective through-body protrusions to anchor or tether a portion of said overmolding material to said holster body, and wherein said through-body protrusion extends beyond at least a portion of a respective one of said plurality of overmold apertures and into said at least partial holster cavity.

2. The overmolded/through-molded holster of claim 1, wherein a portion of said overmolding material is affixed to a portion of said exterior surface of said holster body by chemical or adhesive attachment.

3. The overmolded/through-molded holster of claim 1, wherein said at least partial holster cavity includes a frame/slide portion and a trigger guard portion.

4. The overmolded/through-molded holster of claim 3, wherein a depth of said frame/slide portion is different from a depth of said trigger guard portion.

5. The overmolded/through-molded holster of claim 1, wherein at least a portion of said at least partial holster cavity is contoured to accommodate a specific type or model of handgun to be retained within said overmolded/through-molded holster.

6. The overmolded/through-molded holster of claim 1, wherein at least a portion of at least one of said one or more wall portions is contoured to accommodate a specific type or model of handgun to be retained within said overmolded/through-molded holster.

7. The overmolded/through-molded holster of claim 1, wherein said holster body is substantially rigid.

8. The overmolded/through-molded holster of claim 1, wherein said overmolding material is more resilient than a material used to form said holster body.

9. The overmolded/through-molded holster of claim 1, wherein at least a portion of at least one of said plurality of respective through-body protrusions extends so as to mushroom beyond at least a portion of a respective one of said plurality of overmold apertures and into said holster cavity.

10. The overmolded/through-molded holster of claim 1, wherein one or more overmold recess ridge segments extend from at least a portion of said exterior surface of said holster body to define an overmold recess, wherein said at least one overmold aperture is formed through one of said one or more wall portions within said overmold recess, and wherein said overmolding material extends within said overmold recess.

11. The overmolded/through-molded holster of claim 1, wherein at least one overmold recess is formed in at least a portion of an exterior surface of said holster body, wherein said plurality of overmold apertures are formed through one of said one or more wall portions within said overmold recess, and wherein said overmolding material extends within said overmold recess.

12. The overmolded/through-molded holster of claim 1, wherein at least a portion of said exterior surface of said holster body is scored or altered to provide surface preparations for attachment or coupling between portions of said exterior surface of said holster body and portions of said overmolding material.

13. The overmolded/through-molded holster of claim 1, wherein at least a portion of a surface of said overmolding material is textured to provide an ornamental appearance to at least a portion of said surface of said overmolding material.

14. The overmolded/through-molded holster of claim 1, wherein at least a portion of a surface of said overmolding material includes tactile variations.

15. An overmolded/through-molded holster, comprising:

a holster body portion, wherein one or more wall portions define an at least partial holster cavity of said holster body portion;

two or more overmold apertures formed through one of said one or more wall portions; and an overmolding material molded atop at least a portion of an exterior surface of said holder body portion as an additional layer of material molded atop said portion of said exterior surface of said holster body portion, wherein a continuous portion of said overmolding material extends through said two or more overmold apertures to form through-body protrusions to anchor or tether a portion of said overmolding material to said holster body portion, and wherein at least a respective portion of at least two of said through-body protrusions extends through and beyond respective ones of said overmold apertures so as to extend beyond at least a portion of each said respective ones of said overmold apertures and into said at least partial holster cavity.

16. The overmolded/through-molded holster of claim 15, wherein at least a portion of said at least two of said through-body protrusions extends through and beyond respective ones of said overmold apertures so as to mushroom beyond at least a portion of each said respective ones of said overmold apertures and into said at least partial holster cavity.

17. The overmolded/through-molded holster of claim 15, wherein said overmolding material is more resilient than a material used to form said holster body.

18. The overmolded/through-molded holster of claim 15, wherein at least one overmold recess is formed in at least a portion of an exterior surface of said holster body, wherein said overmold apertures are formed through one of said one or more wall portions within said overmold recess, and wherein said overmolding material extends within said overmold recess.

19. The overmolded/through-molded holster of claim 15, wherein at least a portion of said exterior surface of said holster body includes surface preparations for attachment or coupling between portions of said exterior surface of said holster body and portions of said overmolding material.

20. A method for producing an overmolded/through-molded holster, comprising:

providing a holster body portion, wherein one or more wall portions define an at least partial holster cavity of said holster body portion, and wherein at least one overmold aperture is formed through one of said one or more wall portions; and molding an overmolding material atop at least a portion of an exterior surface of said holster body portion as an additional layer of material molded atop said portion of said exterior surface of said holster body portion, wherein an integrally formed portion of said overmolding material is injected or molded through said at least one overmold aperture to form one or more through-body protrusions to anchor or tether said overmolding material to said holster body portion, and wherein each of said through-body protrusions extends through and beyond said at least one overmold aperture, into said at least partial holster cavity.

* * * * *